United States Patent [19]

Ross

[11] Patent Number: 4,536,959

[45] Date of Patent: Aug. 27, 1985

[54] FOLDING KNIFE

[75] Inventor: Mark A. Ross, P.O. Box 12, Greta Valley, North Canterbury, New Zealand

[73] Assignees: Mark Anthony Ross, N. Canterbury; Robert Allen Hiseman, Christchurch, both of New Zealand

[21] Appl. No.: 433,782

[22] Filed: Oct. 12, 1982

[30] Foreign Application Priority Data

Oct. 12, 1981 [NL] Netherlands ..... 198614

[51] Int. Cl.[3] ..... F41B 13/08

[52] U.S. Cl. ..... 30/161; 30/331

[58] Field of Search ..... 30/153, 155–157, 30/160, 161, 331, 337, 342, 344; 143/64; 81/177 R, 177 E, 177 ST; 7/168

[56] References Cited

U.S. PATENT DOCUMENTS

| | | | |
|---|---|---|---|
| 107,223 | 9/1870 | Chapman | 30/344 |
| 1,397,018 | 11/1921 | Priestman | 30/155 |
| 4,083,110 | 4/1978 | Goldin et al. | 30/155 |

FOREIGN PATENT DOCUMENTS

| | | |
|---|---|---|
| 17448 | 4/1881 | Fed. Rep. of Germany . |
| 16251 | 12/1881 | Fed. Rep. of Germany . |
| 21152 | 2/1882 | Fed. Rep. of Germany . |

*Primary Examiner*—Douglas D. Watts

*Attorney, Agent, or Firm*—Burns, Doane, Swecker & Mathis

[57] ABSTRACT

A folding knife including a blade and a handle which are joined together by a pivot at a forward end of the handle, an axis of the pivot is in the same plane as the blade and the handle and joins same to a tang portion of the blade so that the blade can pivot laterally from an extended position through about 180° to a second position where the blade lies within the confines of the handle. The top and/or bottom of the tang is generally rectangular in section and engages in a similarly shaped recess formed in upper and/or bottom arms of the handle, the upper and/or bottom arms of the handle incorporate a mechanism for moving the arms apart to enable the tang to be disengaged from the recess to swing the blade laterally either to its open or closed position. The top of the tang can have locking surfaces associated therewith which engage with a recess in the arm of the handle adjacent thereto to lock the blade in its open or closed position. The locking surfaces can be located on a rectangular lug formed on the tang or in the handle which is arranged to lock the handle, arm and tang in their open or closed position.

11 Claims, 8 Drawing Figures

FOLDING KNIFE

FIELD OF THE INVENTION

This invention relates to a knife and more particularly to a folding knife of the type in which a blade thereof can be moved laterally relative to a supporting handle to a closed, storage or safety position within the confines of the handle.

DESCRIPTION OF THE PRIOR ART

A number of constructions of foldable knife are currently available and generally these are dimensioned so that they can be used as pocket knives. In most such known knives a blade thereof is pivotable from a closed position within the confines of the knife handle to an open position with the blade extending from and supported by the handle.

One such known foldable knife is that described in U.S. Pat. specification No. 4,083,110 (Goldin et al.). This specification describes a knife having a blade with a tang positioned between the arms of a U-shaped handle. A pivot pin engages the tang between the arms so that the blade can be swung laterally from between the arms to an extended position. The tang is engaged relative to the arms by shaping either the upper or lower or both the upper and lower surfaces of the tang and the arms to form interfitting convex-concave shapes. The resilient bias of the arms when held tends to hold the tang and arms together so that the blade extends out co-extensively from the hand.

A major disadvantage of this construction of knife is that the concave-convex securing structure is yieldable, i.e., in its extended and closed position the blade is not rigidly locked relative to the handle unless it is firmly gripped by a users hand. The consequences of this when the user is only casually gripping the handle are obvious. It is clear that lateral pivoting can occur if the knife is used with a sideways movement. The blade can accidently disengage and result in the user cutting himself or herself. A further disadvantage of this construction of knife is that a person generally needs to use two hands to open the knife. It is virtually impossible to use one hand to push against the side of the blade to overcome the inherent inward resilience of the arms at the same time as holding the handle.

Other constructions of knife with blades which pivot have required the blade to pivot about a pin extending at right angles to the plane of the knife blade through 180° from an open to a closed position within the confines of the handle.

A disadvantage of this construction is also that two hands are required in order to open or fold out the blade. The pin holding the blade and the leaf spring which normally locks the blade in position both of which are positioned near to an end of the blade also constitute an inherent weakness in the construction of such a knife.

An object of the present invention is to provide a folding knife which overcomes at least in part the disadvantages mentioned and which offers to the public a useful alternative choice.

SUMMARY OF THE INVENTION

According to the present invention there is provided a folding knife including a blade and a handle which are joined together by pivot means at a forward end of the handle, an axis of the pivot means is in the same plane as the blade and the handle and joins same to a tang portion of the blade so that the blade can pivot laterally from an extended position through about 180° to a second position where the blade lies within the confines of the handle, the top and/or bottom of the tang is generally rectangular in section and engages in a similarly shaped recess formed in upper and/or bottom arms of the handle, the upper and/or bottom arms of the handle incorporate means for moving the arms apart to enable the tang to be disengaged from the recess to swing the blade laterally either to its open or closed position.

According to a second aspect of the present invention there is provided a folding knife including a blade and a handle which are joined together by pivot means which extend therebetween at a forward end of the handle, an axis through the pivot means is in the same plane as the blade and of the handle, the pivot means enables the blade to pivot laterally from an extended position through about 180° to a second position where the blade lies within the confines of the handle, the top and/or bottom of the tang and the upper or bottom arms of the handle associated therewith have shaped means associated therewith which engage with similarly shaped apertures in the tang or handle adjacent thereto to lock the blade in its open or closed position, the upper and/or bottom arm of the handle incorporate means for moving the arms apart to enable disengagement of the means from the apertures to allow the blade to swing laterally either to its open or closed position where engagement of the means occurs.

The means can be a square or rectangular lug formed on the tang or in the handle and arranged to lock the handle, arm and tang in their open or closed position.

The handle member can include means for locating and/or locking the tang in association therewith to retain the blade in its folded, extended or second position against the accidental folding thereof.

Further aspects of the present invention which should be considered in all its novel aspects will become apparent from the following description which is given by way of example only.

BRIEF DESCRIPTION OF THE DRAWING

Examples of the present invention will be described with reference to the accompanying drawing in which.

DESCRIPTION OF THE PREFERRED EMBODIMENTS

Figure 1:
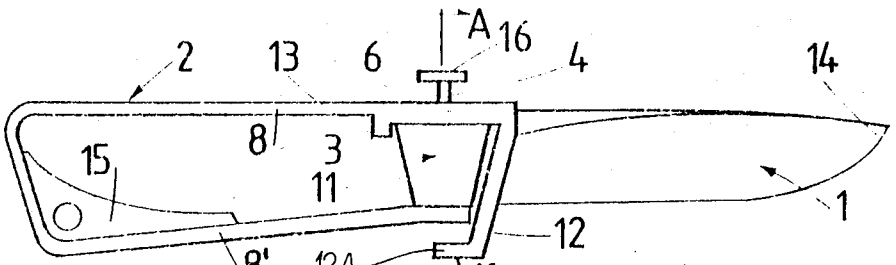
FIG. 1 shows a side view of an example of folding knife when in its open or extended position.

The knife the subject of the present invention can be manufactured using known methods of manufacture from known materials. Preferably the blade thereof is constructed from stainless steel. The handle member can be constructed from a metal, metal alloy or resilient plastics material.

In the drawing the parts of the knife shown in the different examples are references by the same numerals. The blade is generally indicated by arrow 1. The handle member is generally indicated by arrow 2.

The blade 1 is shaped as required and terminates in a base or tang region 3. The tang 3 has in association therewith a pivot pin 4. In FIG. 1 a single pivot pin 4 extends through a hole 5 formed in the tang 3.

The handle member 2 which has a pair of arms has at a front end 6 thereof holes 7 through which the pivot pin 4 extends.

Alternatively the handle member 2 can have two pivot pins in association therewith which extend into separate upper and lower holes (not shown) formed in the tang 3.

In the example shown in FIG. 1 the handle 2 has an upper arm 8 and a lower arm 8' forming a U-shaped frame handle. It is to be appreciated that the upper and lower arms 8 and 8' can be formed in a single operation. Alternatively the upper arm 8 can be formed in association with a side plate (not shown) which has an inwardly biased lower movable arm 8' associated therewith. The side plate is included if it is desired to limit accessibility to the blade when it is within the confines of the arms 8 and 8'. In FIG. 1 the upper arm 8 has a channel portion 9 (FIG. 7) at the forward end thereof which defines a recess. The recess includes a locking surface 9A which contacts corresponding locking surfaces 3A on the tang 3 and thus serves to firmly (unyieldingly) locate the blade 1 in either its open or closed position.

The upper and lower arms 8 and 8' can be moved apart a small distance in the directions of arrow 10 to allow the blade 1 to pivot laterally.

Figure 3:
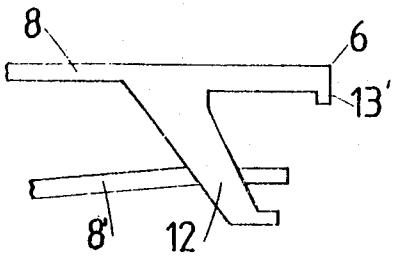
FIG. 3 shows a side view of part of a handle member including an alternative construction of means for moving the arms thereof apart.

It is to be appreciated that in an alternative construction (not shown) either or both the upper or lower arms 8 and 8' respectively can have a channel portion 9 formed therein. The end 11 of the tang 3 is dimensioned to extend beyond the pivot pin 4 to allow adequate engagement between the back of the blade and the channel 9. The handle 2 can be shaped to allow a side plate to be provided in one side of the handle in which case an arm 12 is positioned (as shown in FIG. 3) instead of as indicated in FIG. 1.

The side edge of the channel 9 can include an abutment 13 which restricts the lateral movement of the blade when it is swinging to its closed position. In the alternative construction shown in FIG. 3 the abutment 13' restricts the opening movement of the blade 1.

Figure 7:
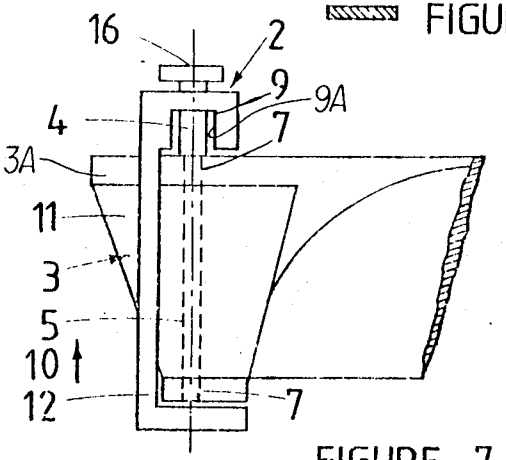
FIG. 7 shows a sectional view on the lines A—A shown in FIG. 1 wherein the blade of the knife is in its partly opened or partly closed position.

In use when the knife is in its open position (FIG. 1) the knife can be used as required. In order to fold the blade 1 to its position where the blade 1 is in juxtaposition with the handle 2 and within the confines of the arms 8 and 8' a remote portion 12A of the arm 12 is pressed in the direction of arrow 10 at the same time as the top of the pin 4 is pressed in the opposite direction to move the arms 8 and 8' apart. This allows the end 11 of the blade to pivot under the lower edge of the upper arm 8 (see FIG. 7). This movement of the arms 8 and 8' allows lateral movement of the blade 1 thus freeing same from the channel portion 9 (FIG. 7). Further pivoting of the blade in the direction of the handle 2 moves the point 14 of the blade 1 against the abutment 13 and into association with the shaped region 15 of the handle 2. In this position the tang 3 is again locked in the channel portion 9.

Figure 2:
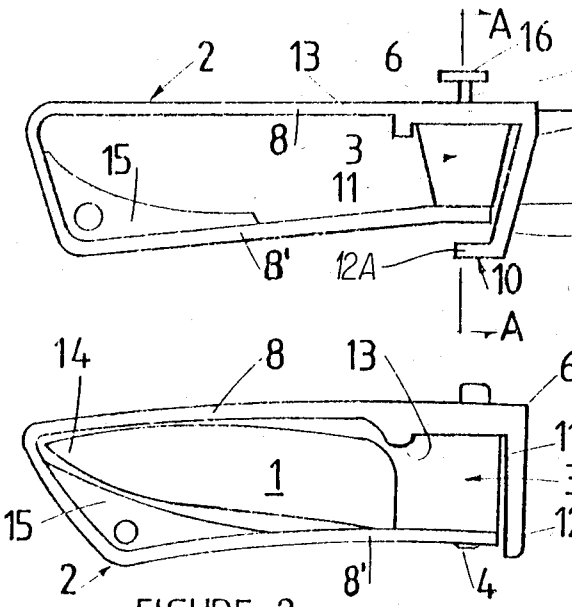
FIG. 2 shows a side view of a knife similar to that shown in FIG. 1 but in its closed or second position and wherein the shape of the top of the pivot pin and the shape of the additional arm are different.

In use to release the knife from its locked position (FIG. 2) downward pressure is exerted on an end 16 of the pivot pin 4 at the same time as upward movement in the direction of the arrow 10 is created by raising the arm 12 and this allows the blade to disengage from the channel 9 and to be flicked about the pivot to its open position. In this position the inherent resilience of the materials from which the arms 8 and 8' are manufactured locks the tang 3 in the channel portion 9.

It is to be appreciated that the locking of the blade 1 relative to the handle 2 in both the open and closed positions can be created by the resilience of the material from which the handle is formed if it is an integrally formed one piece handle. Alternatively if one of the arms is formed separately a biasing means (not shown) can be included to bias the arms inwardly toward each other.

Figure 5:
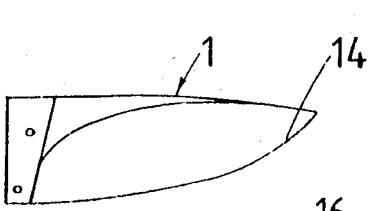
FIG. 5 shows a side view of a replaceable blade usable with the tang shown in FIG. 4.
Figure 6:
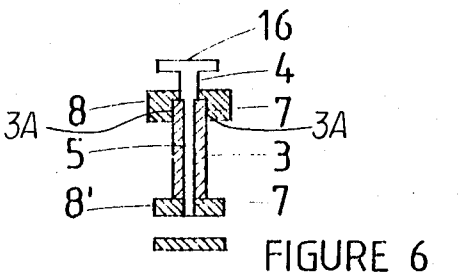
FIG. 6 shows a section on the lines A—A through the knife shown in FIG. 1.
Figure 8:
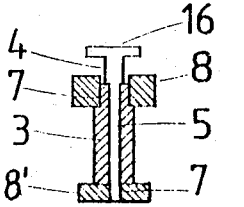
FIG. 8 shows an alternative section through the knife shown in FIG. 1 with a different method of positioning and locking the blade in position.
Figure 4:
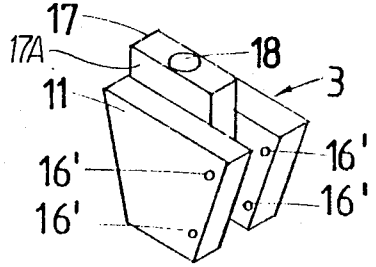
FIG. 4 shows a perspective view from above of part of a tang to which a replaceable blade can be attached.

The example of blade 1 shown in FIGS. 4 and 5 is fabricated in two parts and fixed together by pins in holes 16. The pins (not shown) enable the blade to be removed and replaced if necessary. This also enables the blade to be pressed in a single operation. The tang 3 of this blade 1 is as can be seen of a different shape to that described with reference to FIGS. 1 and 6.

This construction has a square or rectangular lug or projection 17 formed therewith. This lug 17 is shaped and positioned to engage in an elongate rectangular hole or aperture (not shown) in the arm 8 whereby locking surfaces 17A of the projection 17 engage the locking surfaces of the recess. The pin 4 which in practice extends through hole 18 is wider in diameter at the top (not shown) than the width of the lug 17. The pin 4 holds the tang 3 in position and tends to force the arms 8 and 8' apart in the same manner as described hereinbefore. The blade 1 is moved laterally in the same manner as hereinbefore described by moving apart the arms 8 and 8' between which the blade is positioned. This movement disengages the lug 17 from the aperture in the blade 8 and allows the blade to move laterally until the lug 17 engages in the other end of the rectangular hole.

Thus by this invention there is provided a folding knife wherein the blade is pivotable laterally relative to the handle between an open or extended position and a closed, storage or safe position in juxtaposition with the handle.

Particular examples of the present invention have been described herein by way of example and it is envisaged that improvements and modifications thereto can take place without departing from the scope and spirit of the appended claims.

What I do claim and desire to obtain by Letters Patent of the United States is:

1. A folding knife comprising:

a handle including upper and lower longitudinally extending arms interconnected at a rear end of said handle to form a generally U-shape as viewed in side elevation, a blade including a cutting edge portion and a tang portion, said tang portion being disposed between said upper and lower arms and having top and bottom edges located adjacent said upper and lower arms respectively, pivot means pivotally connecting said blade to a forward end of said handle, said pivot means extending through said tang portion to define a pivot axis lying within the plane of said tang portion and about which said blade can be rotated by about 180 degrees between a forwardly projecting open position and a rearwardly projecting closed position, one of said upper and lower edges of said tang portion including a portion of rectangular cross-section and the one of said arms situated adjacent said one edge including a recess of correspondingly rectangular cross-section, said portion of the tang and said recess in the arm being mutually engageable when said blade is in said open and closed positions to unyieldingly resist lateral forces applied to said blade and which tend to rotate said blade about said pivot axis, and an additional arm connected to said one arm and projecting across and beyond the blade toward the other of said arms such that a distal portion of said additional arm is disposed beyond said other arm, thereby enabling said handle to be manually gripped by a user's hand with one finger on said distal portion, said pivot means being manually displaceable along said pivot axis relative to said one arm by an engageable end of said pivot means projecting beyond said one arm and adapted to be engaged by another finger of the user's hand, said pivot means being connected to said tang portion such that when said engageable end is depressed by said other finger while said handle is held by the user's hand and while said one finger exerts pressure on said distal portion, said pivot means pushes said tang portion against said other arm to move said other arm away from said one arm to thereby mutually disengage said portion of rectangular cross-section to enable said blade to be rotated about said axis.

2. A folding knife as claimed in claim 1, wherein said portion of rectangular cross-section is disposed in said upper edge of said tang portion.

3. A folding knife as claimed in claim 2, wherein said one arm comprises said upper arm and said one edge comprises said top edge of said tang portion.

4. A folding knife as claimed in claim 1, wherein said first and second arms are integrally joined as a one-piece unit.

5. A folding knife as claimed in claim 1, wherein said distal portion of said additional arm longitudinally overlaps said other arm and is spaced therefrom in a direction parallel to said axis.

6. A folding knife as claimed in claim 5, wherein said additional arm extends from said one arm at a location rearwardly of said pivot means.

7. A folding knife as claimed in claim 5, wherein said tang portion is connected to said cutting edge portion by transverse pins.

8. A folding knife as claimed in claim 1, wherein said blade is formed of stainless steel.

9. A folding knife as claimed in claim 8, wherein said handle is formed of plastic.

10. A folding knife as claimed in claim 1, wherein said pivot means comprises a pivot pin.

11. A folding knife as claimed in claim 10, wherein said tang portion extends beyond said pivot pin in both directions of said blade.

* * * * *